United States Patent [19]

Blakewood

[11] Patent Number: 4,854,609

[45] Date of Patent: Aug. 8, 1989

[54] BUSINESS FORM FEEDING LEADER SYSTEM

[75] Inventor: James C. Blakewood, Savanah

[73] Assignee: Blakewood Business Forms, Inc., Ga.

[21] Appl. No.: 194,922

[22] Filed: May 17, 1988

[51] Int. Cl.[4] ..... B42D 3/00; B42D 17/20; B41L 1/20; B65D 27/100

[52] U.S. Cl. ..... 281/2; 281/5; 282/12 R; 229/69

[58] Field of Search ..... 281/2, 5, 8, 4, 11; 282/2, 8 R, 3 B, 5, 7, 8 B, 8 R, 12 R, 61, 62; 229/69

[56] References Cited

U.S. PATENT DOCUMENTS

| | | | |
|---|---|---|---|
| 3,877,728 | 4/1975 | Herz | 281/5 |
| 4,508,365 | 4/1985 | Haynes | 281/2 |
| 4,568,108 | 2/1986 | Simpson | 282/12 R |
| 4,735,437 | 4/1988 | Fattibene | 281/5 |

*Primary Examiner*—Frank T. Yost
*Assistant Examiner*—Paul M. Heyrana, Sr.
*Attorney, Agent, or Firm*—Cushman, Darby & Cushman

[57] ABSTRACT

The present invention relates to a business form including a specialized folding leader section that will allow the form to be fed into a computer controlled printer and, in a convenient manner, appropriately positioned the leading edge of the first form section within that computer, appropriately aligned with the printer. The folding leader strips also allow the appropriate folding of a plurality of forms in a storage container.

5 Claims, 3 Drawing Sheets

BUSINESS FORM FEEDING LEADER SYSTEM

The present invention relates to an improved way of constructing a continuous series of business form sets. Each set is comprised of a plurality of serially attached sheets together with an improved leader section. This combination allows such form sets to be uniformly folded within shipping and storage containers while also providing a way to appropriately feed such forms into computer controlled printers so that the top of the form can be appropriately positioned with respect to a character printing head.

BACKGROUND OF THE PRESENT INVENTION

The business forms industry has been changing markedly in recent years in order to accommodate the changing nature and structure of business equipment. This is especially true of business forms designed for use, in a continuous feed manner, in computer controlled printers. Business forms are sometimes printed in a way that utilizes both sides of a piece of paper in an effort to conserve both space and the number of sheets required. While it is common to connect many of these forms together in a serial fashion so that continuous feeding is possible, to do so produces a combination form that will not permit each form to be properly positioned at the correct point with respect to the character printing element or print head. This result occurs because many printers employ a paper pulling mechanism or feed that is positioned vertically above the print head. Where that situation exists and the form requires data to be entered at the top of the form, one form in the set must be used to properly align the following form at the proper level with the print head.

However, to conserve and not waste forms such forms are sometimes removed from a continuous set and used as individual sheets of paper. This requires one side to be completed, then the form must be removed from the machine, reinserted and the second side completed. This approach does not lend itself to an appropriate use of computer controlled printers where continuous feed of materials is desirable.

Similarly, the type of form arrangement where one form directly follows another does not lend itself to use in computer controlled equipment due to the arrangement of the print head within a computer controlled printer. In many printers, the print head is not aligned directly with the feed rollers used to feed paper therethrough, but rather is positioned at a point spaced vertically below those feed rollers. This arrangement makes it impossible to both feed a form and align the top portion of that form relative to the print head. Even where there is relative alignment between a print head and the feed rollers, it is difficult to correctly position a form, where the top of that form has spaces where data is required to be entered, properly in front of the print head.

Accordingly, it is common to use a single sheet, nonfolding leader at the beginning of forms to assist in feeding forms through printers.

Many reports required in industry, particularly in the real estate business where various types of appraisal forms are required, employ legal sized documents. Further, many require the use of several pages, most frequently two pages.

It is most convenient to print such reports in an end to end fashion so that the report can be filled out in a continuous manner pursuant to and using computer generated data to complete the blanks on the form. It is also desirable to use every form and not waste one form every time the completing of a form is necessary.

Another constraint is that business form printing presses which can produce continuous forms that are 34 inches in length are rare, and the folding of such forms must take this unusual length into consideration.

SUMMARY OF THE PRESENT INVENTION

Present invention relates to an improved leader arrangement for cooperating with legal sized forms, either single or multi-part forms, that allows the resulting combined form system or set to be folded into 17 inch lengths, half of the 34 inch printing length, which provides sufficient leader length to permit the paper pulling or feed mechanisms, conventionally used in computerized printers and located at a point spaced vertically above the printing elements, to properly feed the continuous forms through the printer. This unique leader arrangement will also appropriately position the top line of each form in the group or set of forms in the correct position so that the top of each form lies adjacent the character print head of the printer.

Other objects, features, and characteristics of the present invention, as well as the methods and operation and functions of the related elements of the structure, and to the combination of parts and economies of manufacture, will become apparent upon consideration of the following description and the appended claims with reference to the accompanying drawings, all of which form a part of this specification, wherein like reference numerals designate corresponding parts in the various figures.

DETAILED DESCRIPTION OF THE PRESENT INVENTION

Figure 1:
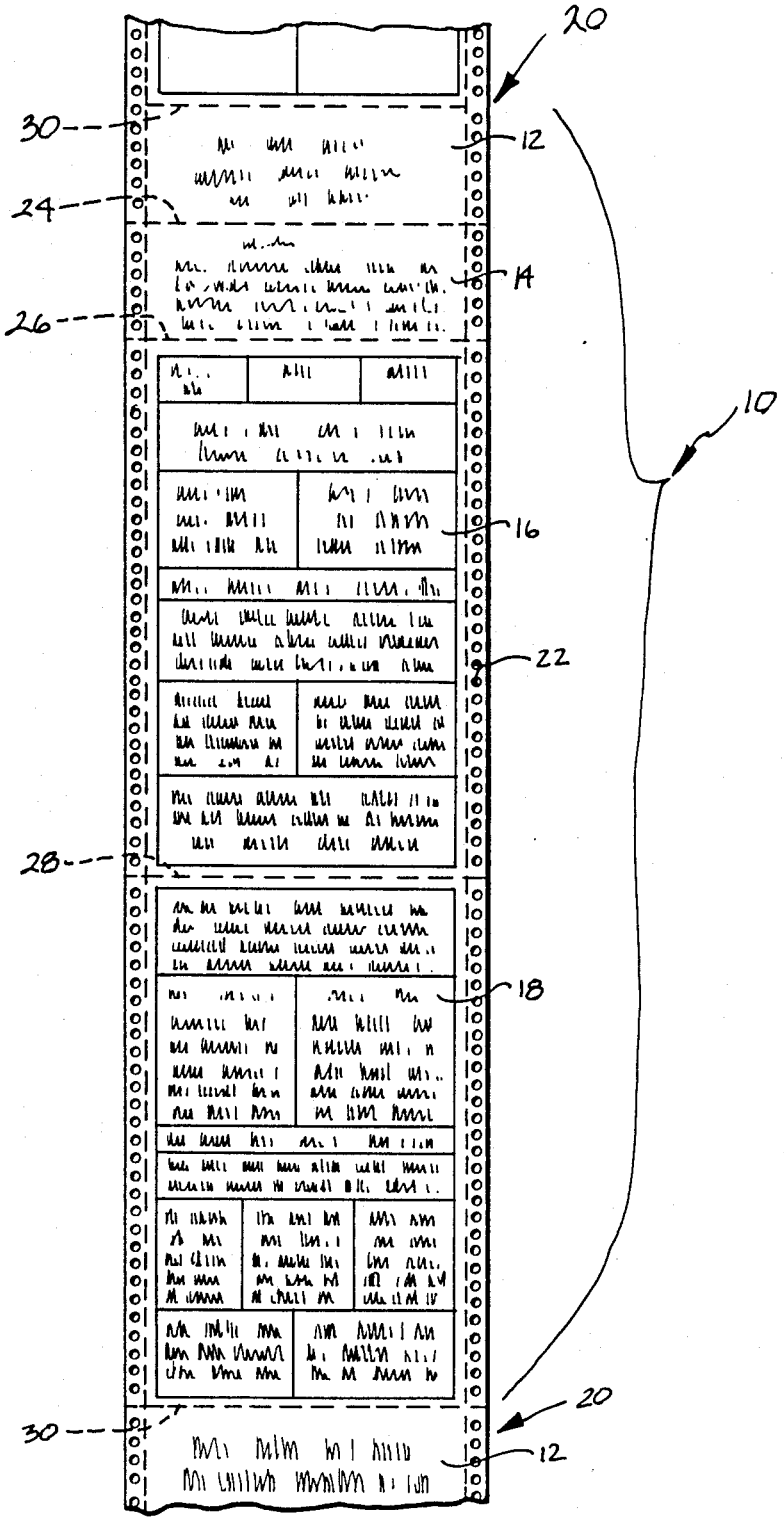
FIG. 1 is a planned view of the business form according to the present invention showing the leader structure together with a two page form.

With reference first to FIG. 1, one full repeat of the continuous form is generally indicated at 10 and is comprised of two leader sections 12 and 14, respectively, as well as two form sections 16 and 18. The beginning of the leader section is generally shown at 20. As shown, forms 16 and 18 are each representative of legal sized documents although other sizes could be used. While this invention works best with legal size documents with leader sections 12 and 14 each being 3 inches in length, the use of this leader with shorter paper would create an appropriately shorter stack length.

As with most standard computerized continuous forms each edge is provided with regularly spaced apertures, generally indicated at 22, to allow feeding by standard and conventional feeding rollers.

One unique feature of the present invention is the way in which the present form is folded. In order for the form 10 to be correctly folded, leader strip 12 is connected to leader strip 14 by a line of perforations 24 extending across the entire width of the form as shown in FIG. 1. A similar line of perforations, indicated at 26, connects leader section 14 to the first form section 16, with the latter being connected to the next or second form section 18 by a line of perforations 28. Form section 18 has its trailing end connected to the next leader section 12 by a line of perforations separately indicated at 30. The same line 30 of perforations is also shown at the top of FIG. 1.

Accordingly, the leading edge of the first leader section 12 is connected to the trailing edge the last form sheet 18. Similarly, the leading edge of the second leader section 14 is connected to the trailing edge of the first leader section 12, and the leading edge of the first form section 16 is connected to the trailing edge of leader section 14. The trailing edge of the first form section 16 is, in turn, connected to the leading edge of the second form section 18. This sequence then repeats throughout the stack or group of continuous forms.

Form sections 16 and 18 each preferably have the same length, about 14 inches long, and the first and second leader sections 12 and 14 also have substantially the same length, preferably about 3 inches long.

Figure 2:
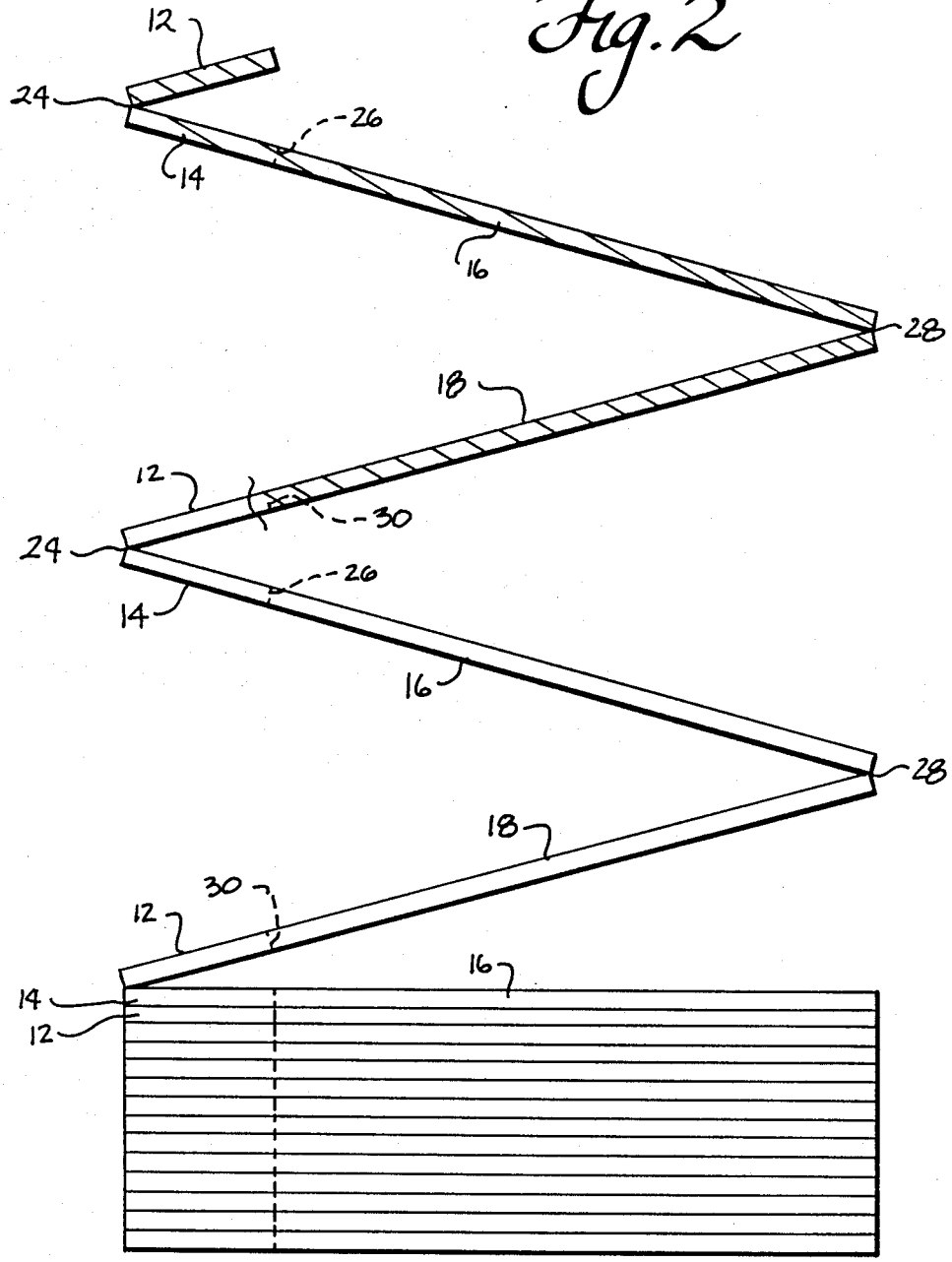
FIG. 2 is a diagrammatic side elevational view of a stack of forms according to the present invention, some of which have been raised upwardly to show the position of the forms and the leader arrangement.

When the forms are folded, as shown in FIG. 2, the first layer at the top of a stack of a plurality or forms would be comprised of the first leader section 12. As shown in FIG. 2, this first section 12 is folded over onto the second leader section 14 so the rear surface of section 12 faces the rear surface of the section 14. The second leader section 14 and the first form section 16 remain as a flat sheet and together form a 17 inch long form segment. This segment also constitutes the second layer. The second form 18 is then connected by its leading edge to the trailing edge of form 16 via the line 28 of perforations. The two form sheets are then folded over one another so that their printed surfaces face each other. Preferably the sheets comprising the form has only one side that is provided with printing although the sheets can have printing on both sides. The trailing edge of form 18 is then connected by the line of perforations 30 to the leading edge of the next first leader section 12. For convenience one forms systems, comprised of two leaders and the attached form sheets, has been delineated by cross hatching.

Figure 3:
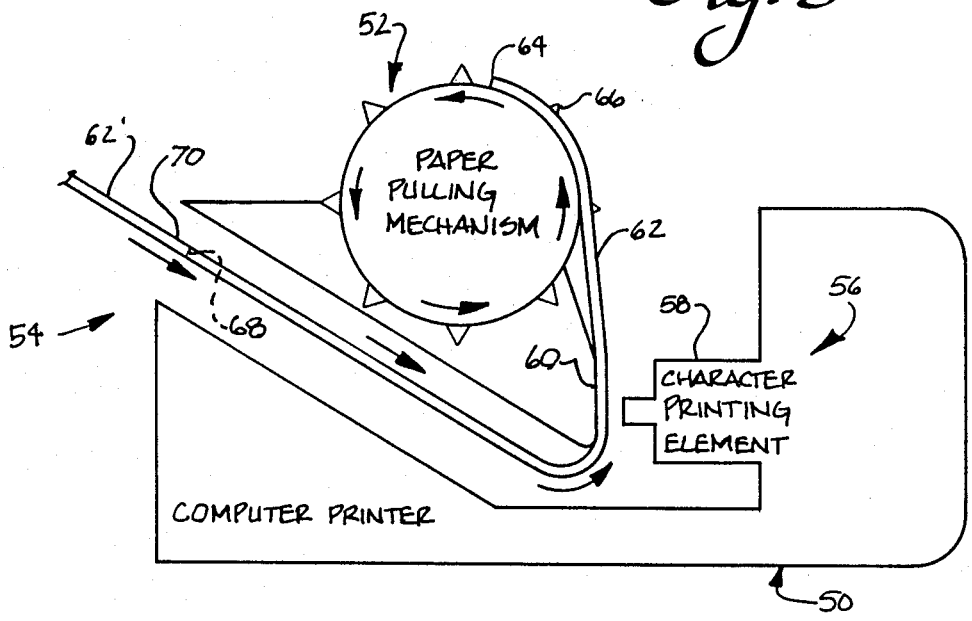
FIG. 3 is a diagrammatic side elevational view of a printer showing the paper pulling mechanism, located above the character printing element, feeding a standard form.

As shown in FIG. 3, a computer controlled printer, generally indicated at 50, includes a paper pulling mechanism or feed assembly, generally indicated at 52, a paper guide inlet area, generally indicated at 54, and a character printing assembly, generally indicated at 56. The latter includes a character printing element 58 that operates against a wall portion 60 which is a part of the paper feed area against which the paper will be supported during printing.

In FIG. 3, a standard form that does not include any leader section is being used and is generally indicated at 62. The leading edge of that form is indicated specifically at 64. The paper pulling mechanism 52 is located at a point spaced vertically above the character printing element 58. For a form to be fed it is necessary that the form engage that paper pulling mechanism which occurs, as shown, by having the projections 66 of the feed rollers extend through apertures 22. In order to accomplish this top of the form 64 will come to be positioned substantially above the point at which the character printer 58 cooperates with wall 60 to effectively print on the form. Only the next form 62', connected to form 62 by means of a line of perforations 68, will be appropriately positioned so that its leading edge 70 is properly aligned with the character printing element 58. This effectively requires the wasting of form 62, which in effect performs the role of a leader for form 62'.

Figure 4:
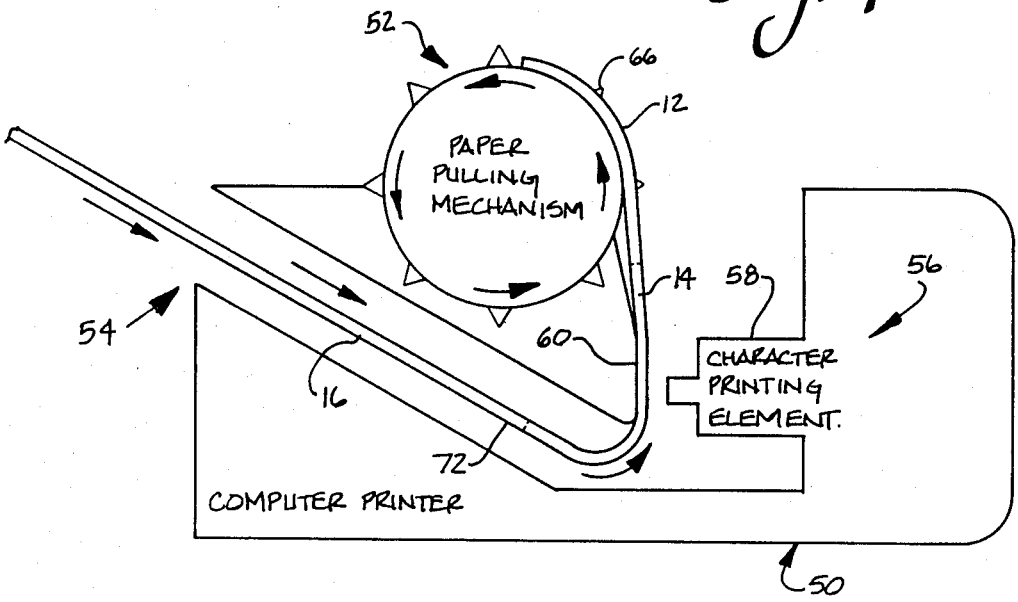
FIG. 4 is a diagrammatic side elevational view of the same printer shown in FIG. 3 but feeding a form according to present invention.

With reference to FIG. 4, the printer is comprised of the same elements as in FIG. 3 above but the form being fed here is formed according to the present invention. As shown, the first leader strip 12 engages the paper pulling mechanism 52 with projections 66 again extending through apertures 22. Leader section 14 is being pulled past the character printing element 58 and feeding will stop once the leading edge 72 of form 16 is appropriately positioned between the character printing element 58 and wall portion 60.

While the invention has been described in connection with what is presently considered to be the most practical and preferred embodiment, it is to be understood that the invention is not to be limited to the disclosed embodiment, but on the contrary, is intended to cover various modifications are equivalent arrangements included within the spirit and scope of the appended claims.

What I claim is:

1. A form system for feeding into computer controlled printers comprising a plurality of folding leader sets, each folding leader set including first and second leader sections with each having a leading and trailing edge connected to each other at their trailing and leading edges, respectively, through a line of perforations, a plurality of separate form sets, each of said form sets having at least two successive sheets of substantially equal length with each sheet having a leading and trailing edge, the successive sheets being joined together at their trailing and leading edges, respectively, by a line of perforations, the trailing edge of said second leader in each set being joined to the leading edge of each form set by a line of perforations and the trailing edge of the second of said two successive sheets in each form set being joined to the leading edge of another leader set by a line of perforations so that the system of forms can be folded in successive sets of repeating layers, each repeating set including a first layer comprised of at least the first leader section, a second layer comprised of the second leader section and the first of said two successive sheets and a third layer including at least the second of said two successive sheets.

2. A form system as in claim 1 wherein said first and second leader sections have substantially the same length.

3. A form system as in claim 2 wherein said length is about 3 inches.

4. A form system as in claim 1 wherein said at least two successive sheets are comprised of legal sized documents.

5. A form system as in claim 1 wherein said at least two successive sheets are about 14 inches in length.

* * * * *